US005357689A

United States Patent [19]

Awai

[11] Patent Number: 5,357,689

[45] Date of Patent: Oct. 25, 1994

[54] VENTILATED FOOTWEAR WITH CLOSURE FLAPS

[76] Inventor: Lyndon Awai, Apt. A-6, Bartram Beach Apartments, 2-4 S. Bartram Ave., Atlantic City, N.J. 08401

[21] Appl. No.: 56,787

[22] Filed: May 4, 1993

[51] Int. Cl.[5] ..... A43B 7/06

[52] U.S. Cl. ..... 36/3 A; 36/3 R

[58] Field of Search ..... 26/3 A, 3 R, 3 B, 131, 26/136; 2/209, 423; 220/335

[56] References Cited

U.S. PATENT DOCUMENTS

| | | | |
|---|---|---|---|
| 163,171 | 5/1875 | Evans | 36/3 A |
| 752,254 | 2/1904 | Patton | 36/3 A |
| 988,011 | 3/1911 | Mitchell | 36/3 A |
| 1,168,166 | 1/1916 | Cook | 36/3 A |
| 1,394,348 | 10/1921 | Pietrowski | 36/3 A |
| 1,616,254 | 2/1927 | De Suarez | 36/3 A |
| 1,718,756 | 6/1929 | Mosquit | 36/3 A |
| 1,797,309 | 3/1931 | Wojciechowski | 36/3 A |
| 2,614,339 | 10/1952 | Herceg | 36/3 A |
| 4,835,883 | 6/1989 | Tetrautt et al. | 36/3 R |
| 4,949,865 | 8/1990 | Turner | 220/335 |
| 4,971,220 | 11/1990 | Kaufman et al. | 220/335 |

FOREIGN PATENT DOCUMENTS

| | | | |
|---|---|---|---|
| 384884 | 2/1908 | France | 36/3 A |
| 519674 | 3/1955 | Italy | 36/3 A |

*Primary Examiner*—Paul T. Sewell
*Assistant Examiner*—Thomas P. Hilliard
*Attorney, Agent, or Firm*—Norman E. Lehrer

[57] ABSTRACT

A footwear ventilation system including the use of ventilation openings and integrally connected flap members. The invention includes the use of vent openings cut out of the side of a shoe. The vent openings may be of any shape to allow sufficient air flow therethrough. Around the periphery of each vent opening and the shoe, extends a perpendicularly oriented male track. A flap is integrally hinged to one side of the vent opening and has a integrally connected female track extending around the periphery of it. To close the vents, the female track of the flap is pushed onto the male track of the opening thereby facilitating a tight seal. When it is desired that the shoe be ventilated, the flap, being hinged to one edge of the opening, is pulled away from the opening, thereby disengaging the male and female tracks. In one embodiment of the invention, the flap or flaps, while integrally hinged to the shoe adjacent an opening, can be attached directly to the shoe. In the second embodiment of the invention, the flaps are adapted to be attached to each other for maintaining the shoe in the ventilated state.

5 Claims, 2 Drawing Sheets

VENTILATED FOOTWEAR WITH CLOSURE FLAPS

BACKGROUND OF THE INVENTION

The present invention relates to shoes or footwear and, more particularly, to an improved system for ventilating footwear which is directed mainly toward the athletic type shoe although applicable to all shoes. The invention allows the wearer of the shoe to ventilate the shoe when desired or necessary and to wear the shoe in the non-ventilated state as desired.

Athletic shoes have increased in complexity over recent years. Complex sole designs and air cushions have been incorporated into the athletic shoe for increasing performance and comfort. Additionally, lighter weight new materials are being incorporated into the athletic shoe or sneaker so as to increase the quickness of the person wearing the shoe. Along with increased performance and exertion in an athletic event or similar undertaking, it is a physiological fact that an athlete or other athletic shoe wearer will sweat at a higher rate. Feet are certainly not immune to natural occurrences of heat increases and sweat build up during exertion. Accordingly, the foot is similarly not immune to the undesirables associated with increased sweat and heat such as odor and wetness. With all the technology directed towards performance, durability and support, the ventilation of the athletic foot, until now, has been slighted. The prior art, however, does include several patents directed toward ventilating shoes in general but which are substantially impractical for athletic shoes and lack some of the important features of the instant invention.

U.S. Pat. No. 2,614,339, for example, to Herceg discloses a ventilated shoe. The shoe, as shown in FIG. 1, has vents located adjacent the shoe tongue area on either side of the tongue. With the vents open, air is allowed to circulate into the foot area. As shown in FIG. 2 of the patent, the vents can be closed via flaps which fold from under the tongue portion and over the ventilation holes. The opening and closing of the vent holes is performed on the inside of the shoe unlike the instant invention. Therefore, if the wearer of the shoe decides to open the vent or close the same for any reason, the shoe has to be removed from the foot. Accordingly, if it is the wearer's decision to open the vent, having to remove the foot from the shoe decreases the usefulness or need for the vents themselves. Also, the inconvenience associated with having to remove the shoe to acquire the benefits of the vents, impedes the lifestyle of the modern athlete. Finally, under situations where it is necessary that the vents be immediately closed, such as inclement weather, it is impractical with the shoe disclosed in Herceg to accomplish this, for the whole foot would wind up getting wet anyway.

U.S. Pat. No. 1,797,309 to Wojciechowski, entitled Ventilated Shoe, discloses a work type shoe having three vent holes on the upper portion of the toe area. If it is desired that the holes be plugged or covered in some manner, a cover is attached to the shoe for moving over the ventilating holes. In the ventilation position, as shown in FIG. 1, the cover spans the shoe tip but may be rotated into a hole covering position when desired. The ventilated shoe in this invention is impractical for athletic type shoes in that the holes are not enough to allow sufficient ventilation and the cover is inconvenient as well as being a potential safety risk during an athletic event. Also, the cover does not have means for creating a seal with the holes thereby allowing water and the like to enter the shoe should the opportunity arise.

U.S. Pat. No. 1,390,929 to Gumaer discloses another ventilated shoe. The shoe has a ventilating strip spanning the toe area adjacent to the sole of the shoe. The strip has a plurality of holes therein which access the inside of the shoe. The holes span the entire length of the strip and are equally spaced thereon. There is also provided a strip covering flap for covering the holes when it is desired that the ventilation be discontinued. The strip is detachable from the shoe and is adapted to be carried in the pocket. Because the location of the holes is adjacent to the sole of the shoe, the ventilation area causes the shoe to be especially susceptible to moisture and dirt, unlike the instant invention, where the ventilation area is well above ground level. Additionally, the hole covering strip must be carried separately from the shoe thereby increasing the risk of loss and misplacement and subsequently increasing the susceptibility of the shoe to moisture and dirt, contrary to the instant invention, where the ventilation covering the flap is connected to the shoe and cannot be lost.

SUMMARY OF THE INVENTION

This invention is directed toward a system for shoe ventilation and, more particularly, ventilation for athletic type shoes. The system of ventilation includes an opening and a flap integral to the shoe which can be sealably attached to the opening for covering the same. With the flap and the opening in the engaged position, the shoe is substantially unsusceptible to the influx of moisture and the like and, while in the unengaged position, the flap can be fastened to the shoe so as to prevent its loss.

The invention disclosed herein is shown in two embodiments. Each embodiment, while different in appearance, functions in substantially the same manner. The first embodiment is comprised of each shoe having a pear shaped vent hole or holes on the side surfaces of the shoe. Each vent hole has a perpendicularly extending track spanning its circumference. A flap, of similar shape to the vent, is hinged to the wide end of the pear shaped vent hole and the flap is solid having a mating track for engaging the track spanning the pear shaped vent hole. The non hinged end of the flap has a hook attached thereto which can engage a ring attached to the back of the shoe for keeping the flap in the open position.

The second embodiment includes two vent holes on one shoe. The vent holes are substantially triangular in shape and are located adjacent the tongue and tie area on both sides of the shoe. Again, similarly shaped flaps are hinged to the area of the vent hole adjacent the tongue area and have mating tracks for sealing the vent hole closed. In the open position, the flaps are adjoined at the center of the shoe and are connected via frictional fastening material and a loop attached thereto which allow the flaps to be mated together above the tie or tongue area. Both of the ventilated openings for each embodiment have a mesh like material covering the same.

Ventilation is accomplished by simply opening the vents and securing the flaps when it is desired that air be circulated through the shoe. Accordingly, when it is desired to vent the shoe, the flaps for either embodiment are simply grabbed and pulled away from the ventilation hole area. The mating tracks will disengage, and the flap may be secured to the shoe as in the first embodiment or to the other flap as in the second embodiment of the invention. Because of the mating and engaging tracks of the flaps and ventilation opening, the shoe is not prone to the influx of moisture or the like during inclement weather or wet terrain while in the closed position.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENT

Figure 1:
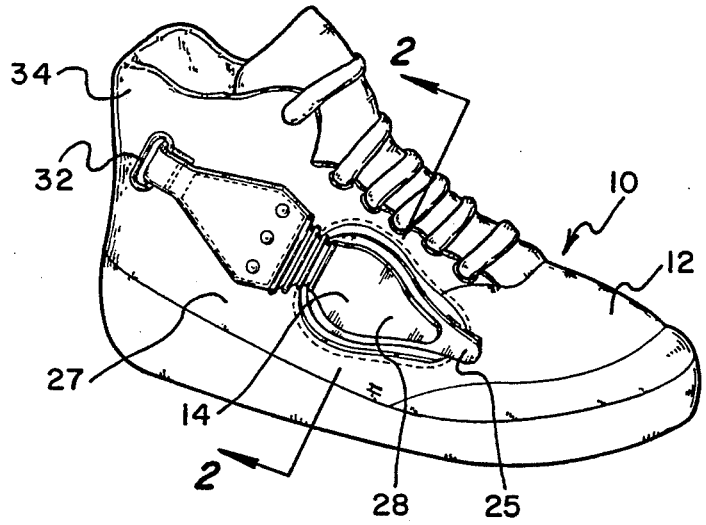
FIG. 1 is a perspective view of the first embodiment of the ventilated shoe disclosed herein showing the shoe in the unventilated state.

Referring now to the drawings in detail, wherein like reference numerals have been used throughout the various figures to designate like elements, there is shown in FIG. 1 a perspective view of the first embodiment of the ventilated shoe constructed in the accordance with the principles of the present invention and designated generally as 10. The shoe 10 is comprised, inter alia, of the upper 12, a flap 14 and a ventilation hole 16.

The ventilation system is essentially comprised of the flap 14 and the vent hole 16. The vent hole 16 is a substantially pear shaped opening cut into the side of the upper 12 of the shoe 10. The opening 16 is covered by a mesh like material 18 which is sewn into the sides or edges of the material surrounding the opening 16. A perpendicularly extending male track 20 extends from and spans the periphery of the opening 16. The track is essentially a thin perpendicular extension of the edge of the hole 16.

Figure 2:
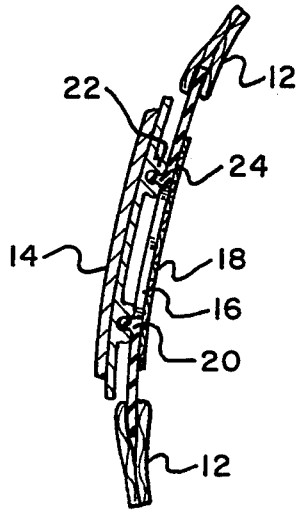
FIG. 2 is a cross-sectional view taken along line 2—2 of FIG. 1.
Figure 3:
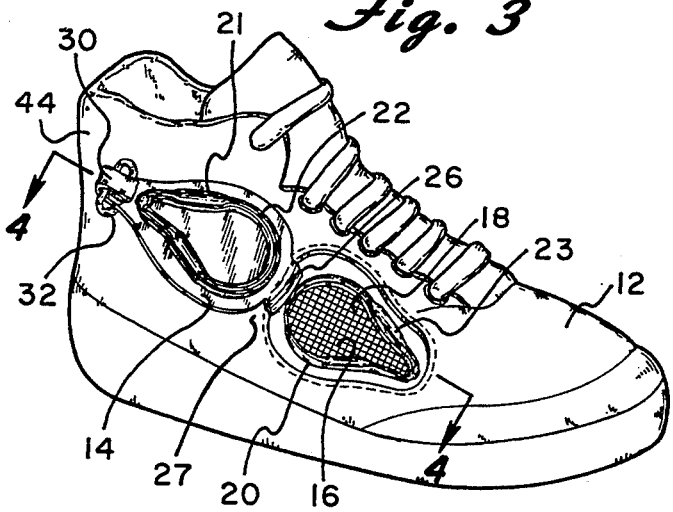
FIG. 3 is a perspective view of the shoe shown in FIG. 1 in the ventilated state.
Figure 4:
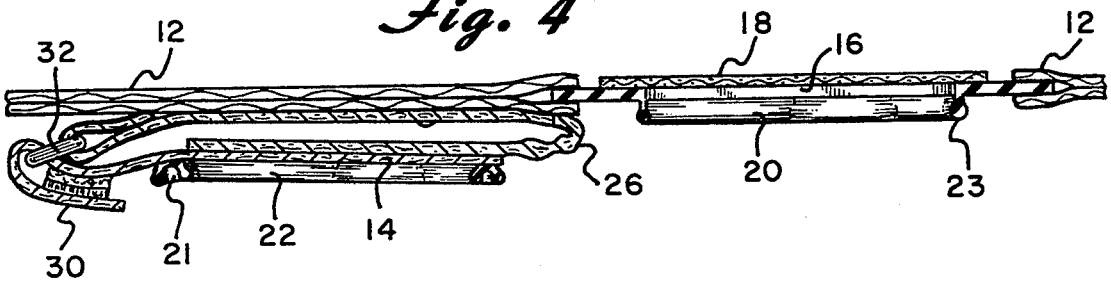
FIG. 4 is a cross-sectional view of the flap and vent hole taken along line 4—4 of FIG. 3.

As shown in FIG. 3, a mating female track 22 extends from the inside of the flap 14. Obviously, the track 22 is similarly pear shaped for engaging the track 20. The track 22 is comprised of two perpendicular extensions having a space 24 therebetween for engaging the track 20. The track 22 is integrally attached, either glued or molded, to the under side of the flap 14 as shown in FIG. 3. As shown in FIG. 2, the track 22 and opening 24 are adapted to engage the track 20 in a snap fit relationship at several locations. At several spots along the male track and the female track, the perpendicular extension 20 and opening 24, respectively, are widened at areas 21 and 23, respectively to allow greater surface contact. These areas 21 and 23 are also formed to have a tighter fitting tolerance therebetween relative to the remaining track portions, as shown in FIG. 3, to facilitate an interference fit. As such, this snap fit relationship causes the flap 14 to be securely fastened to the track 20 as shown in FIG. 1. The tracks 20 and 22 are also constructed from a rubbery and resilient material such that a sealing effect is caused.

The flap 14 has a tip 25 and is integrally attached to the shoe upper 12 via a molded hinge 26 which is also attached to the upper 12 at the large end 27 of the vent opening 16. The hinge 26 is preferably molded along with the flap 14 such that it is integral thereto. The hinge 26 is ridged so as to facilitate bending susceptibility. At the free end 28 of the flap 14, a frictional fastening material member 30 such as Velcro or the like extends from the flap. The member 30 is adapted to be threaded through a ring 32 which is sewn or otherwise attached to the high end 44 of the upper 12 and be fastened back onto itself. As shown in FIG. 3, while in the open position, the member 30 can be threaded through the ring 32 so as to sustain the flap 14 in the open position. In the preferred embodiment, for both the left and right shoe, the flap and vent/hole combination is located on the outwardly facing side of the shoe. However, the pear shaped ventilation system could also be on both sides of the shoe.

Figure 5:
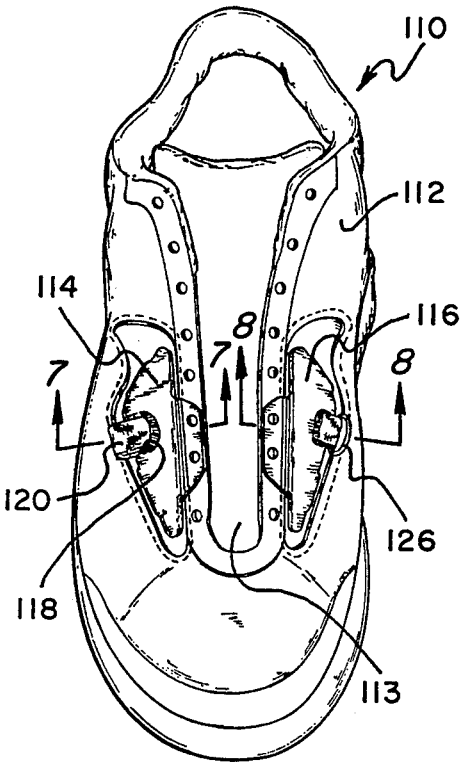
FIG. 5 is a front perspective view of the second embodiment of the invention showing the dual vents in the unventilated state.
Figure 6:
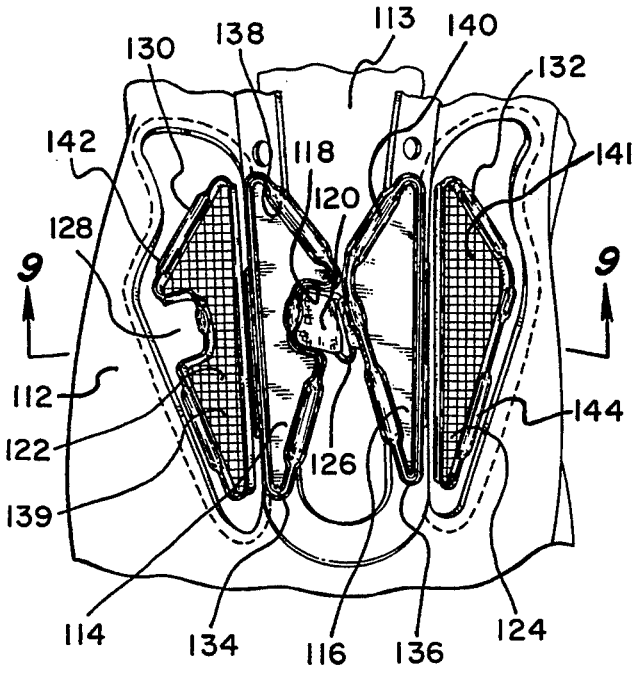
FIG. 6 is a blown up view of the ventilation openings and flaps with the openings in the ventilated state and the flaps attached together.

The second embodiment 110 of the ventilated shoe 112 is shown in FIG. 5 and, while it is differently configured, the features are essentially the same as the first embodiment 10. As shown in FIG. 5 and 6, the vent openings are substantially triangular in shape and are positioned adjacent the tongue or tie area 113. The flaps 114 and 116 are substantially similar but have different securing features. The flap 114 is substantially triangular having a rectangular cutout 118 at its free edge. A frictional material fastening strip 120 is sewn into the cutout 118 for fastening the flap to the sister flap 116 over the toe or tie area 113. The fastener 120 is sewn into the material surrounding the cutout 118. The straight edge of the flap 114 is attached via a hinge 121 to the shoe 112 adjacent the toe area 113 and adjacent the straight edge of the vent opening 122.

The sister flap 116 is similarly attached to the shoe adjacent the toe area but on the opposite side of the flap 114. The straight edge of the flap 116 is attached via a hinge 123 adjacent the straight edge of the vent hole 124. The flap 116 is substantially triangular having a loop 126 attached to and extending therefrom at its free edge as shown in FIG. 6. The loop 126 is for engaging the Velcro-like fastening strip 120 of flap 114 for securing the flaps together and above the tongue area 113. Referring to FIG. 6, the opening 122 located on the left side of the shoe is also substantially triangular in shape, but similar to the flap 114, has a rectangular cutout 128 therein. The rectangular cutout 128 is for receiving the fastener 120 when the vent hole is closed as shown in FIG. 5. The opening 124 is substantially triangular in shape similar to the flap 116.

Figure 7:
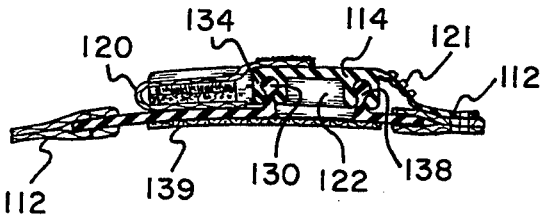
FIG. 7 is a cross-sectional view taken along line 7—7 of FIG. 5.
Figure 8:
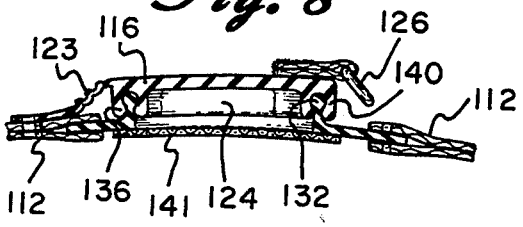
FIG. 8 is a cross-sectional view taken along line 8—8 of FIG. 5.

Both of the vent openings 122 and 124 have perpendicularly extending male tracks 130 and 132, respectively, spanning the periphery of each. The tracks 130 and 132 are substantially resilient extensions for engaging female tracks 134 and 136 which span the periphery of flaps 114 and 116, respectively. The tracks 134 and 136 attached to flaps 114 and 116, respectively, are the female counterparts of tracks 130 and 132 and are adapted to engage the male tracks 130 and 132, respectively. The tracks 134 and 136 are comprised of a pair of perpendicular extensions as shown in FIG. 7 and 8, having slots 138 and 140 therebetween, respectively.

As shown in FIG. 6, the tracks 134 and 136 and openings 138 and 140 are adapted to engage the tracks 130 and 132 in a snap fit relationship at several locations. At several spots along the male tracks and the female tracks, the perpendicular extensions 130 and 132 and openings 138 and 140, respectively, are widened at areas 142 and 144 and areas 146 and 148, respectively, to allow greater surface contact. These areas 142 and 146 and areas 144 and 148 are also formed to have a tighter fitting tolerance therebetween relative to the remaining track portions, as shown in FIG. 6, to facilitate an interference fit. As such, this snap fit relationship causes the flaps 114 and 116 to be securely fastened as shown in FIG. 5. The tracks are also constructed from a rubbery and resilient material such that a sealing effect is caused. The male and female tracks can be separated upon the application of a light pulling force.

Each of the vent openings 122 and 124 have mesh like material 139 and 141, respectively, covering the opening and sewn to the material surrounding the same. As shown in FIG. 6, when the vents are open in the second embodiment, the flaps 114 and 116 are positioned above the tongue section 113 and are attached via the fastener 120 extending through the loop 126 (shown also in FIG. 9).

The use of the ventilation technique and features of this invention are readily apparent by viewing the drawings. For the first embodiment, if it is desired that the shoe be ventilated, the flap 14 is grasped at the tip 25 and pulled outwardly. The flap 14 is drawn completely backward until it lies flat with the upper 12. The hook 30 of the tip 25 is then fastened to the loop or ring 32 located at the high end 34 of the upper 12. As shown in FIG. 3, the shoe is now in the ventilated state. If it is desired to seal the shoe or ventilated hole due to inclement weather or any other reason, the hook 30 is merely disconnected from the loop 32 and the slot 24 of female track 22 of the flap 14 is pushed onto the male track 20 of ventilation hole 16 to facilitate a sealed shoe.

Figure 9:
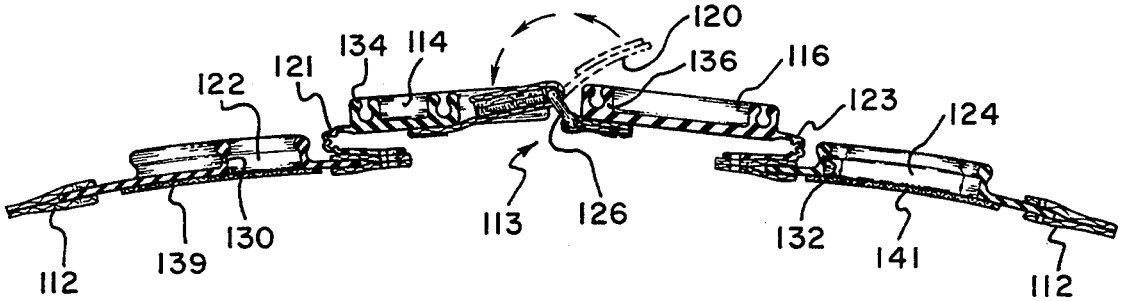
FIG. 9 is a cross-sectional view taken along line 9—9 of FIG. 6.

Referring now to FIGS. 5 through 9, the second embodiment of the invention is used in a similar manner. If it is desired that the shoe be ventilated, the flaps 114 and 116 are pulled upwardly upon and moved over the tongue area 113. As shown in FIG. 9, while the flaps 114 and 116 are over the tongue area 113, the fastener 120 of flap 114 is placed through the loop 126 of flap 116 and fastened as shown in FIG. 9. In this position, the shoe is ventilated. Similar to the first embodiment, if it is desired that the vent holes be closed for any reason, the flaps are simply moved back into engagement with the vent holes. Accordingly, the slots 138 and 140 of flaps 114 and 116, respectively, are pushed onto the male tracks 130 and 132, respectively, of vent openings 122 and 124. Upon the full engagement of the slots with the tracks, the vent holes 122 and 124 become substantially sealed as shown in FIG. 5.

The present invention may be embodied in other specific forms without departing from the spirit or essential attributes thereof and accordingly reference should be made to the appended claims rather than to the foregoing specification as indicating the scope of the invention.

What is claimed is:

1. An article of footwear in the form of an athletic shoe having an outer surface said shoe including an inwardly facing side panel, an outwardly facing side panel and a tongue area, said shoe further comprising ventilation means incorporated in said outer surface-for allowing air to circulate therethrough, said ventilation means comprising first and second vent openings in said outer surface, one of said openings located on each side panel of said shoe adjacent said tongue area and first and second vent covering flaps, each of said openings having one of said flaps attached adjacent thereto, said flaps being hinged to said outer surface adjacent said tongue area for selectively causing said vent openings to be in an open air circulating position or a closed position, each of said flaps being adapted to be opened in a direction substantially transverse to the lengthwise direction of said shoe, said flaps and said vent openings having mutually engaging surfaces for sealably closing said vent openings, said flaps being adapted to engage said openings in said closed position and being adapted to engage each other via a frictional fastening extension and a loop attached to said flaps when in said open position.

2. The invention according to claim 1 wherein said engaging surfaces comprise a male track extending around the periphery of said vent opening and a mating female track extending around the periphery of said flap, said tracks being adapted to engage in a locking manner.

3. The invention according to claim 1 wherein said vent opening is covered with a mesh material.

4. An article of footwear in the form of an athletic shoe having an inwardly facing side panel, an outwardly facing side panel and a tongue area, said shoe further comprising:

an outer surface;

ventilation means incorporated in said outer surface for allowing air to circulate therethrough, said ventilation means comprising a vent opening in said outer surface and a vent covering flap hinged to the outer surface adjacent to said tongue area and being adapted to be opened in a direction substantially transverse to the lengthwise direction of said shoe for selectively causing said vent opening to be in an open air circulating position or a closed position;

said flap and said vent opening having mutually engaging surfaces for sealably closing said vent opening;

said flap having means for securing the same to said footwear for maintaining said vent opening in said open position, said securing means comprising a loop attached to said shoe and a frictional fastening extension attached to said flap, said securing means being adapted to have said loop and said frictional fastening extension engaged in said open air position and disengaged in said closed position, and said engaging surfaces being comprised of a male track extending around the periphery of said vent opening and a mating female track extending around the periphery of said flap, said male track being comprised of an upstanding wall with an enlarged upper portion and said female track being comprised of a pair of extensions having a space therebetween for engaging the male track in a locking manner.

5. An article of footwear in the form of an athletic shoe having an inwardly facing side panel, an outwardly facing side panel and a tongue area, said shoe further comprising:

an outer surface;

ventilation means incorporated in said outer surface for allowing air to circulate therethrough, said ventilation means comprising a pair of vent openings in said outer surface, one of said openings located on each side panel of said shoe adjacent said tongue area, and a pair of vent covering flaps hinged to the outer surface adjacent to said tongue area, each of said flaps being associated with a different one of said vent openings and being adapted to be opened in a direction substantially transverse to the lengthwise direction of said shoe for selectively causing its respective vent opening to be in an open air circulating position or a closed position, said flaps being adapted to engage said openings in said closed position and being adapted to engage each other in said open position by way of a frictional fastening extension and a loop attached to said flaps;

each of said flaps and its respective vent opening having mutually engaging surfaces for sealably closing the vent opening, and said engaging surfaces being comprised of a male track extending around the periphery of said vent opening and a mating female track extending around the periphery of said flap, said male track being comprised of an upstanding wall with an enlarged upper portion and said female track being comprised of a pair of extensions having a space therebetween for engaging the male track in a locking manner.

* * * * *